US006466749B1

(12) United States Patent
O'Brien

(10) Patent No.: US 6,466,749 B1
(45) Date of Patent: Oct. 15, 2002

(54) ADJUSTABLE DEVELOPER RATIO FORMING METHOD AND APPARATUS

(75) Inventor: Katherine N O'Brien, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/722,580

(22) Filed: Nov. 28, 2000

(51) Int. Cl.[7] ..... G03G 15/08

(52) U.S. Cl. ..... 399/27; 399/53; 399/258; 399/259

(58) Field of Search ..... 399/27, 28, 29, 399/35, 43, 53, 119, 120, 252, 253, 254, 255, 258, 262, 60, 58, 259; 430/120, 122; 222/63; 353/300

(56) References Cited

U.S. PATENT DOCUMENTS 4,370,053 A * 1/1983 Hirayama et al. ..... 399/60
4,614,165 A * 9/1986 Folkins et al. ..... 430/120 X
4,625,895 A * 12/1986 Tsukano ..... 222/63
4,974,024 A * 11/1990 Bares et al. ..... 399/58
4,996,566 A * 2/1991 Morita et al. ..... 399/28
5,202,769 A * 4/1993 Suzuki ..... 358/300
5,327,196 A * 7/1994 Kato et al. ..... 399/58
5,450,178 A * 9/1995 Kawashima et al. ..... 399/262
5,722,020 A * 2/1998 Matsuoka et al. ..... 399/262 X
6,125,243 A * 9/2000 Shoji et al. ..... 399/29
6,266,493 B1 * 7/2001 Farrell et al. ..... 399/24

* cited by examiner

*Primary Examiner*—Hoan Tran
(74) *Attorney, Agent, or Firm*—Oliff & Berridge, PLC

(57) ABSTRACT

A variable developer forming method and apparatus that replenishes toner in an image forming apparatus, including a controller that determines a first supply amount and a second supply amount based on an analysis of a document to be printed, a toner storage device that variably releases toner into a developer supply device based on the first supply amount and a carrier storage device that variably releases carrier into the developer supply device based on second supply amount.

27 Claims, 5 Drawing Sheets

300

| PRINT JOB (310) | % BLACK (320) | % CYAN (330) | % MAGENTA (340) | % YELLOW (350) | ... |
|---|---|---|---|---|---|
| 1 | 30 | 0 | 0 | 0 | |
| 2 | 20 | 5 | 20 | 40 | |
| 3 | 0 | 25 | 30 | 30 | |
| 4 | 70 | 0 | 0 | 0 | |
| 5 | 20 | 0 | 20 | 0 | |
| ⋮ | | | | | |

ADJUSTABLE DEVELOPER RATIO FORMING METHOD AND APPARATUS

BACKGROUND OF THE INVENTION

1. Field of Invention

This invention relates to image forming devices.

2. Description of Related Art

Toner particles are used with a transfer drum or development roll to create patterns on a recording medium. To enable electrostatic charging and transfer of toner particles, the toner is mixed with carrier beads of opposite polarity. Carrier material generally comprises low friction beads that interact with the toner particles to ensure proper charging and even toner flow.

Developer results when toner particles are mixed with carrier material in the appropriate ratio. Developers in cartridges or in housings are replaced when either the toner or the carrier degrades to an unacceptable level. Conventionally, toner and carrier are mixed at a ratio of 75% carrier to 25% toner, initially forming a mixture called replenisher. Replenisher can then be added to developers in cartridges or in housings to extend the life of the developer by replacing the carrier material at the same time toner is added. Spent developer is gathered into a waste container for disposal.

SUMMARY OF THE INVENTION

This invention relates to systems and methods for dynamically adjusting the ratios of toner and carrier added to a developer mixture.

For example, low area coverage images require little toner. However, the developer is churned the same amount regardless of the amount toner used, to ensure good quality printing. Thus, when forming a low area coverage image, the carrier is aged more than in a high area coverage image. The systems and methods of this invention adjust the ratios of toner and carrier added depending on the area coverage or density of a particular image. Thus, the time between replacement of the developer or developer cartridge can be increased, leading to better quality images at a lower cost.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the invention will be described in detail with reference to the following figures, wherein like numerals reference like elements, and wherein.

DETAILED DESCRIPTION OF PREFERRED EMBODIMENTS

Figure 1:
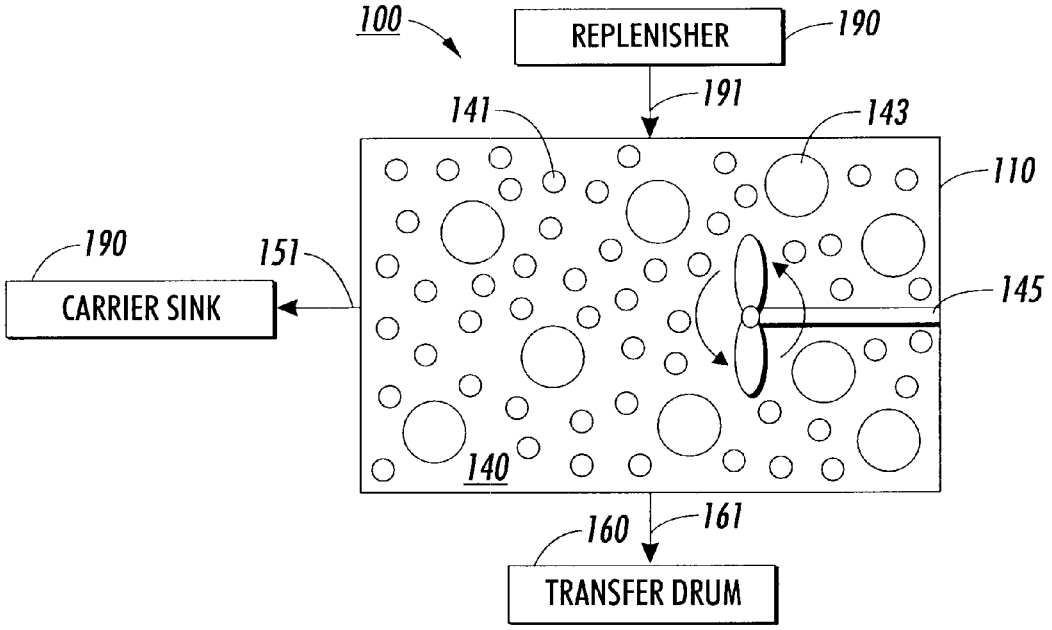
FIG. 1 RELATED ART
FIG. 1 illustrates the conventional system for replenishing developer in a developer cartridge or housing.

FIG. 1 shows a conventional system 100 for replenishing developer in a trickle developer unit 110. The trickle developer unit 110 includes an agitator 145, a supply path 151 to a carrier sink 150, and a supply path 161 to a transfer drum 160. The trickle developer unit 110 also includes toner particles 141 and carrier particles 143 located in a developer sump 140.

When producing images, the agitator 145 agitates the toner particles 141 and the carrier particles 143 in the developer sump 140. Toner is then transferred via the supply path 161 to the transfer drum 160 or developer roll so that an image can be produced. Waste carrier is transferred via the supply path 151 to the carrier sink 150. As the developer, i.e., the combined toner particles 141 and the carrier particles 143, is used to produce images, the developer in the developer sump 140 will age and the toner will be consumed.

To replenish the developer in the trickle developer unit 110, a replenisher 190 adds developer to the developer sump 140 through a developer replenisher path 191. The replenisher 190 stores premixed developer created by combining 25% toner particles 143 with 75% carrier particles 141 during manufacture of the replenisher 190.

Figure 2:
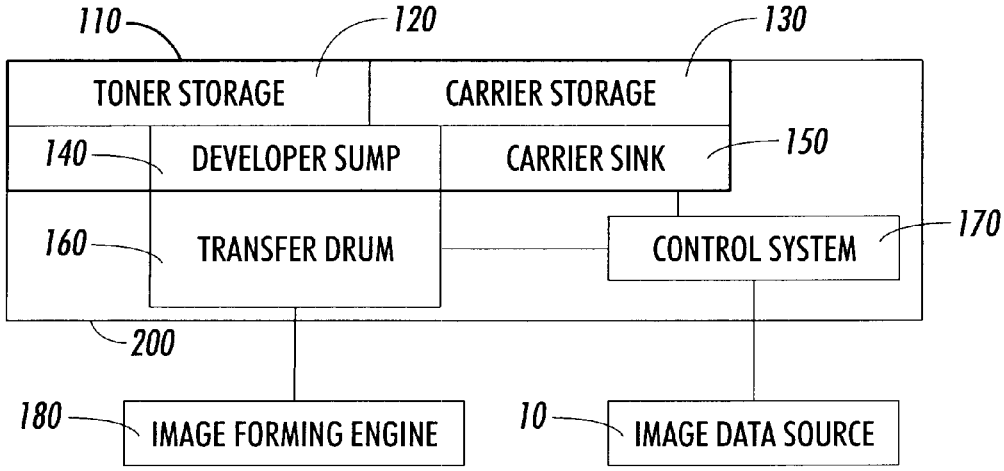
FIG. 2 is a block diagram illustrating a first exemplary embodiment of the structure of an image forming device that incorporates various exemplary embodiments having a variable ratio developer supplying system according to this invention.

However, eventually the developer in the trickle developer unit 110 will age and image quality will be compromised. Continuing addition of replenisher to the developer will no longer rejuvenate the developer. At this point it is necessary to replace the trickle developer unit 110. FIG. 2 is a block diagram of an image forming device 200. The image forming device 200 includes a trickle developer unit 110 that transfers toner to a transfer drum 160 or transfers developer to a developer roll under the control of a controller 170. The controller 170 receives image information from an image data source 10. The trickle developer unit 110 includes a toner storage device 120 and a carrier storage device 130, which feed toner particles 141 and carrier particles 143, respectively, to a developer sump 140. The used carrier particles are discarded from the developer sump 140 into a carrier sink 150.

In operation, the image data source 10 transfers image information to the image forming device 200 such that an image may be created. In particular, the controller 170 of the image forming device 200 receives the image information. The controller 170 then controls the transfer drum 160 and the trickle developer unit 110 to feed developer, i.e. toner and carrier, from the trickle developer unit 110 to the transfer drum 160, which then transfers the toner to an image forming engine 180 of the image forming device 200. Alternatively, the controller 170 may also be used to control the trickle developer unit 110 to feed developer, i.e. toner and carrier, from the trickle developer unit 110 to the developer roll, which then transfers the toner to an image forming engine 180 of the image forming device 200. The image forming engine 180 uses the transferred toner to create a toner image and transfers the toner image to a recording medium. In other exemplary embodiments, any other known or later-developed device or apparatus can be used to transfer the developer from a developer mixer to a medium recording, as is well known in the art.

The trickle developer unit 110 can add appropriate amounts of the toner particles 143 from the toner storage unit 120 and the carrier particles 141 from the carrier storage unit 130 to the developer sump 140. For example, in a low area coverage image, very little toner should be added from the toner storage unit 120. In general, just enough of the toner should be transferred from the toner storage unit 120 to create the image on the recording medium. Additional amounts of the toner can be added to account for other losses, such as toner lost to the carrier sink 150, as is known in the art. The actual amount of toner to be added can be determined by any known or later developed technique without departing from the spirit and scope of the invention.

The carrier storage unit 130 adds an appropriate amount of the carrier to the developer sump 140. For example, if the image to be created is a high area coverage image, the toner storage unit 120 can add a large amount of the toner to the developer sump 140. The carrier storage 130 can then add a small amount of the carrier to the developer sump 140. The amount of carrier added from the carrier storage 130 can be determined by any known or later-devised method without departing from the spirit and scope of the invention.

In this exemplary embodiment, as additional toner and carrier particles are added to the developer sump 140, waste carrier and residual toner are transferred to the carrier sink 150. Thus, appropriate amounts of usable carrier and toner can be maintained in the developer sump 140. However, other means of discarding or using toner and carrier are also possible. For example, in other exemplary embodiments, waste carrier can be retained within the developer sump 140, or can be recycled into the carrier storage 130.

Figure 3:
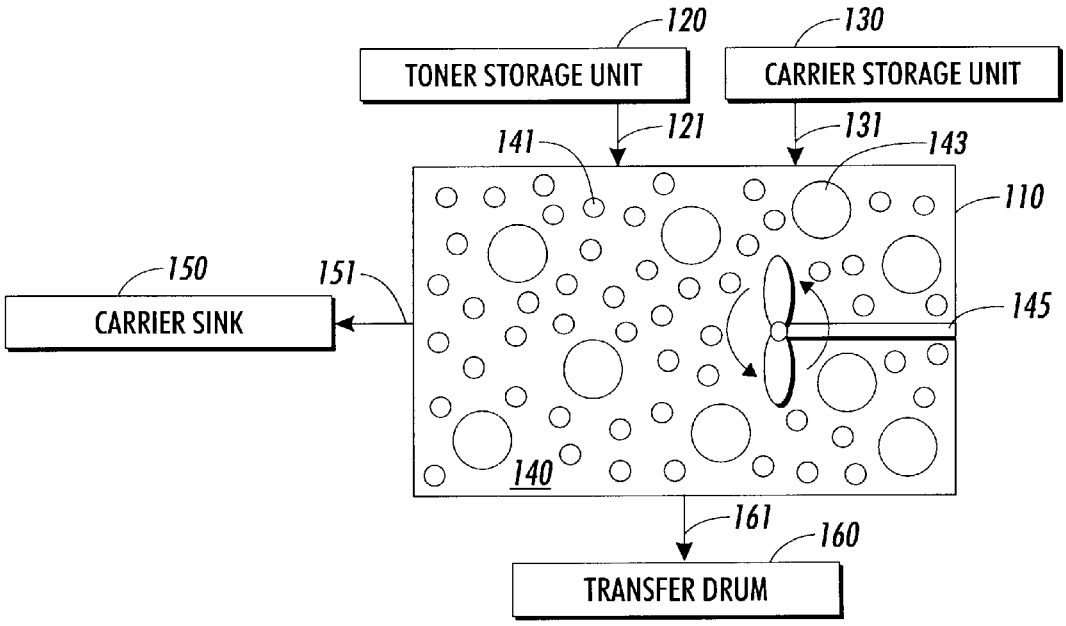
FIG. 3 is a block diagram of one exemplary embodiment of a developer cartridge or housing having a variable ratio developer supplying system according to this invention.

FIG. 3 shows a first exemplary embodiment of the developer replenishing system according to this invention. As shown in FIG. 3, the trickle developer unit 10 includes the developer sump 140, the toner supply path 121, the developer supply path 161, the carrier sink 150, the supply path 151, the toner storage unit 120, the transfer drum 160, the carrier storage unit 130, and the carrier supply path 131.

To create an image, the developer sump 140 transfers toner via supply path 161 to the transfer drum 160. In addition, waste carrier is transferred via the supply path 151 to the carrier sink 150. To replace the toner particles 143, toner particles 143 are transferred to the developer sump 140 via the toner supply path 121 from the toner storage unit 120. To replenish the carrier particles 141, carrier particles are transferred to the developer sump 140 via the carrier supply path 131 from the carrier storage unit 130. Toner particles 143 can be added from the toner storage unit 120 in an amount related to the amount of toner consumed by the imaging process. Carrier particles 141 are transferred from the carrier storage unit 130 in an amount related to the amount of carrier particles 141 that will be transferred to the carrier sink 150. An even mixture is maintained by the agitator 145, which agitates all of toner particles 143, and carrier particles 141 in sump 140.

Thus, the developer replenishing systems and methods of this invention directly add appropriate amounts of the toner particles and the carrier particles to the trickle developer unit 110. The toner particles and carrier particles are separately stored in the image forming device 200. The trickle developer unit 110 can thus be used for increased periods of time. In addition, the toner transferred to transfer drum 160 or the developer transferred to the developer roll can be of a predetermined quality.

Figure 4:
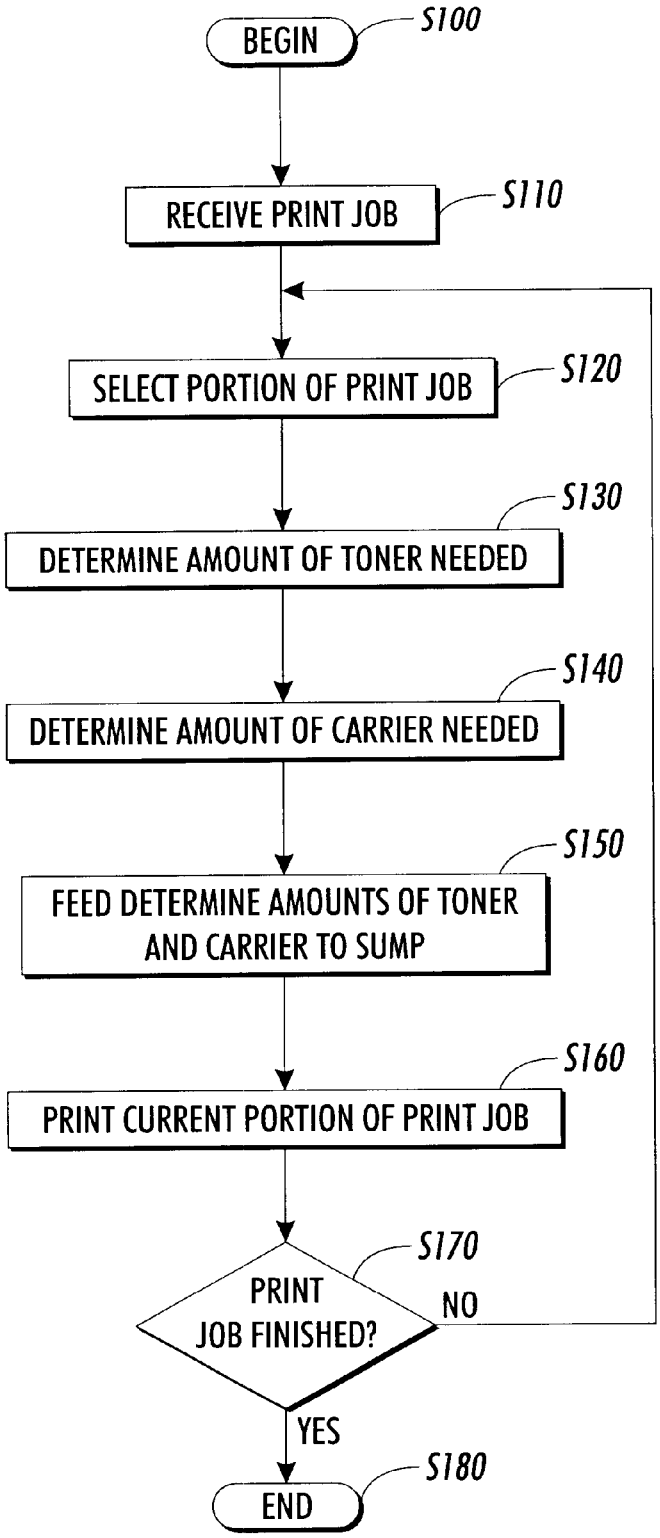
FIG. 4 is a flowchart outlining one exemplary embodiment of a method for determining the mixture of toner and carrier according to this invention.

FIG. 4 is a flowchart outlining one exemplary embodiment of a method for determining the mixture of toner and carrier. Beginning in step S100, control continues to step S110, where the print job is received. Then, in step S120, a first portion of a print job is selected. Next, in step S130, an amount of toner needed for the selected portion of the print job is determined. Control then continues to step S140.

In step S140, an amount of carrier needed is determined based on the amount of toner needed, the area coverage and density of the print job, the size of the print job, the speed at which the image system is run, and/or the period of time that the print job will take. Additional factors are possible and can be used without departing from the scope and intent of the invention. Next in step S150, the determined amounts of toner and carrier are fed to a sump. Then in step S160, the current portion of the print job is printed. Control then continues to step S170.

In step S170, a determination is made whether the print job is finished. If the print job is finished, control continues to step S180, where the method ends. Otherwise, if the print job is not finished, control jumps back to step S120.

Figures 5, 6:
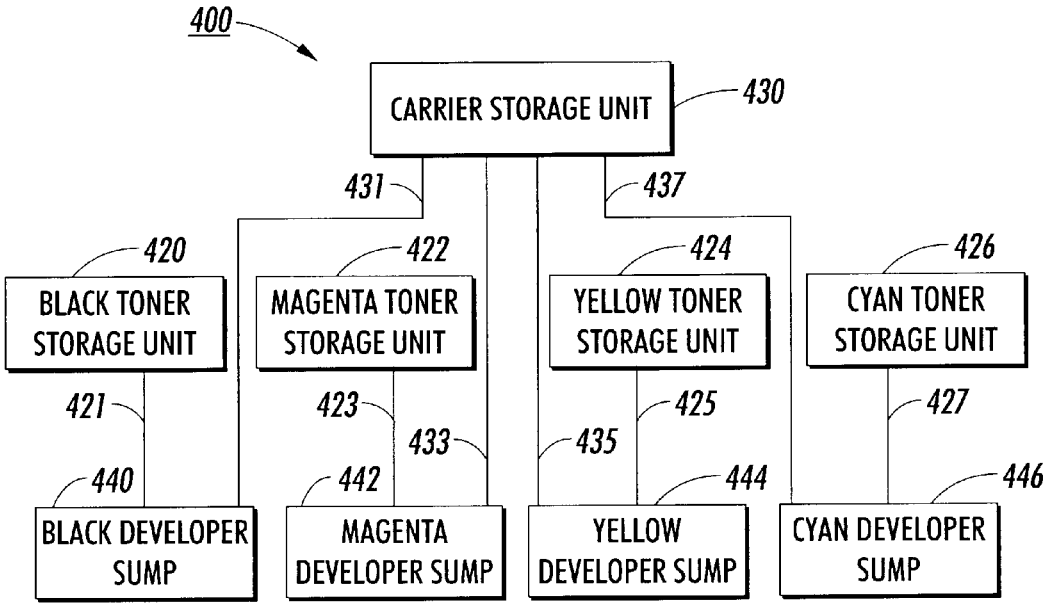
FIG. 5 is a table showing exemplary results of determining the amount of toner needed.
FIG. 6 is a block diagram illustrating a second exemplary embodiment of the structure of a color printing device according to the invention.

FIG. 5 is one exemplary embodiment of a table 300 usable to determine, or showing the results of determining, the amount of toner needed. The table 300 includes a column 310 for print job, a column 320 for the percentage of black toner, a column 330 for the percentage of cyan toner, a column 340 for the percentage of magenta toner the and a column 350 for the percentage of yellow toner.

Thus, the table 300 is an exemplary embodiment of the results of the determination made in step S130. Alternatively, the table 300 is an exemplary embodiment of the results of the amount of the toner to be added to the developer sump 140 in FIG. 3.

FIG. 6 shows an exemplary embodiment of a multicolor image forming device 400 according to the invention. The multicolor image forming device 400 includes a carrier storage unit 430, a black toner storage unit 420, a magenta toner storage unit 422, a yellow toner storage unit 424 and a cyan toner storage unit 426. The black toner storage unit 420 feeds black toner via a toner path 421 to a black developer sump 440, which also receives carrier from the carrier storage unit 430 via a supply path 431. The magenta toner storage unit 422 feeds magenta toner via a toner supply path 423 to a magenta developer sump 442, which also receives carrier from the carrier storage unit 430 via a supply path 433. The yellow toner storage unit 424 feeds yellow toner via a toner supply path 425 to a yellow developer-sump 444, which also receives carrier from the carrier storage unit 430 via a supply path 435. The cyan toner storage unit 426 feeds cyan toner via a toner supply path 427 to a cyan developer sump 446, which also receives carrier from the carrier storage unit 430 via a supply path 437.

Figure 7:
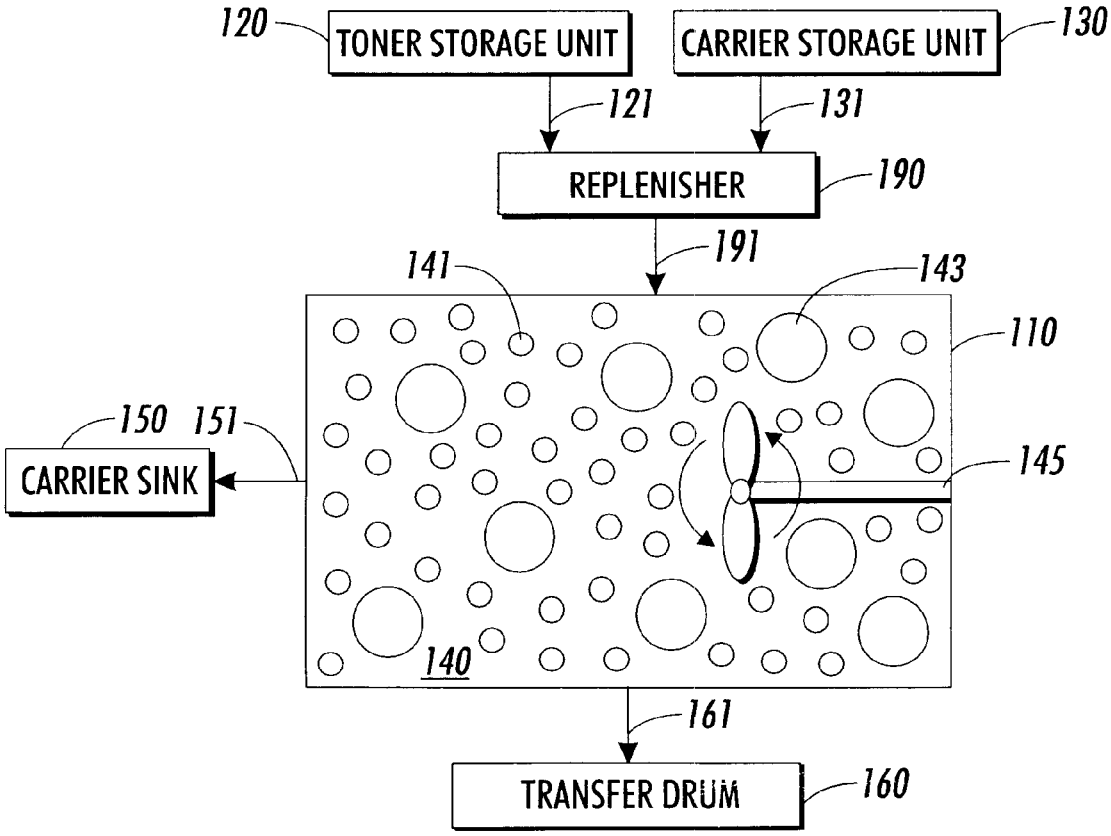
FIG. 7 is a block diagram illustrating a second exemplary embodiment of a developer cartridge having a variable ratio developer supplying system according to this invention.

FIG. 7 is a block diagram of second exemplary embodiment of a developer replenishing system according to this invention. As shown in FIG. 7, the image forming device 100 includes the trickle developer unit 110, the transfer drum 160, and the controller 170. The trickle developer unit 110 includes the toner storage device 120, the carrier storage device 130, which feed the toner particles 143 and the carrier particles 141, respectively to a replenisher 190. The toner particles 143 and the carrier particles 141 are mixed in the replenisher 190. The mixture is then supplied to the developer sump 140 through a supply line 191. Used carrier is discarded into a carrier sink 150.

The trickle developer unit 110 can add appropriate amounts of the toner from the toner storage unit 120 and the carrier from the carrier storage unit 130 to the replenisher 190. For example, in a low area coverage image, very little toner should be added from the toner storage unit 120. In general, just enough of the toner should be transferred from the toner storage unit 120 to create the image on the recording medium. Additional amounts of the toner can be added to account for other losses, such as toner lost to the carrier sink 150, as is known in the art. The actual amount of toner added can be determined by any known or later developed technique without departing from the spirit and scope of the invention.

The carrier storage unit 130 can add an appropriate amount of the carrier to the replenisher 190. For example, if the image to be created is a high area coverage image, the toner storage unit 120 can add a large amount of the toner to the replenisher 190. The carrier storage 130 can then add a small amount of the carrier to the replenisher 190. Alternately, the amount of carrier to be added can be increased or remain constant in relation to decreases in the amount of toner to be added. The amount of carrier added from the carrier storage 130 can be determined by any known or later-devised method without departing from the spirit and scope of the invention.

In this exemplary embodiment, as additional toner and carrier particles are added to the replenisher 190, which then adds the mixture to the developer sump 140, appropriate amounts of usable carrier and toner can be maintained in the developer sump 140.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A system for replenishing toner in an image forming apparatus, comprising:

a control system that determines at least one of a first supply amount and a second supply amount based on an analysis of a document to be printed;

a toner storage device that variably supplies toner into a developer supply device based on the first supply amount; and a carrier storage device that variably supplies carrier into the developer supply device based on the second supply amount.

2. The system of claim 1, wherein the first and second supply amounts are different from each other.

3. The system of claim 1, wherein the first supply amount and the second supply amount are related by being percentages of a fixed amount.

4. The system of claim 1, wherein at least one of the first supply amount and the second supply amount is fixed.

5. The system of claim 1, wherein the toner is at least one of a black toner and at least one colored toner.

6. An image forming apparatus comprising the replenishing system of claim 1.

7. The image forming apparatus of claim 6, wherein the image forming apparatus is at least one of a printer, copier, facsimile machine and plotter.

8. The system of claim 1, wherein the developer supply device is a sump.

9. The system of claim 1, wherein the developer supply device is a replenisher.

10. The system of claim 9, wherein the replenisher supplies toner and carrier to a sump.

11. An image forming apparatus, comprising:

a control system that receives image data;

at least one toner storage device that stores toner;

at least one carrier storage device that stores carrier; and at least one developer supply device that receives toner from the at least one toner storage device and carrier from the at least one carrier storage device;

wherein the control system controls the at least one toner storage device and the at least one carrier storage device to variably feed an amount of toner and an amount of carrier to the at least one developer supply device depending on at least one characteristic of the received image data.

12. The apparatus of claim 11, wherein the amount of toner and the amount of carrier are different from each other.

13. The apparatus of claim 11, wherein the first supply amount and the second supply amount are related by being percentages of a fixed amount.

14. The apparatus of claim 11, wherein at least one of the first supply amount and the second supply amount are fixed.

15. The apparatus of claim 11, wherein the toner is at least one of a black toner, and a colored toner.

16. The image forming apparatus of claim 11, wherein the image forming apparatus is at least one of a printer, copier, facsimile machine and plotter.

17. The apparatus of claim 11, wherein the developer supply device is a sump.

18. The apparatus of claim 11, wherein the developer supply device is a replenisher.

19. The apparatus of claim 18, wherein the replenisher supplies toner and carrier to a sump.

20. A method for producing developer, comprising:

determining an amount of toner needed for forming at least a portion of an image;

determining an amount of carrier needed for forming at least the portion of the image;

releasing at least one of the determined amount of carrier and the determined amount of toner into a developer supply device.

21. The method of claim 20, wherein releasing the at least one determined amount comprises releasing at least one of the determined amount of carrier and the determined amount of toner into a sump.

22. The method of claim 20, wherein releasing the at least one determined amount comprises releasing at least one of the determined amount of carrier and the determined amount of toner into a replenisher.

23. The method of claim 22, wherein releasing the at least one determined amount further comprises supplying toner and carrier from the replenisher to a sump.

24. The method of claim 20, wherein the amount of toner and the amount of carrier are different from each other.

25. The method of claim 20, wherein the amount of toner and the amount of carrier are related by being percentages of a fixed amount.

26. The method of claim 20, wherein at least one of the amount of toner and the amount of carrier are fixed.

27. The method of claim 20, wherein the toner is at least one of a black toner, and a colored toner.

* * * * *